United States Patent [19]

Sorbie

[11] Patent Number: 4,811,642

[45] Date of Patent: Mar. 14, 1989

[54] KITCHEN GUILLOTINE

[76] Inventor: Charles Sorbie, 208, Alwington Place, Kingston, Ontario, Canada, K7L 4P8

[21] Appl. No.: 103,396

[22] Filed: Oct. 1, 1987

[51] Int. Cl.[4] ..... B26D 3/24

[52] U.S. Cl. ..... 83/574; 83/608

[58] Field of Search ..... 83/574, 607, 609, 675, 83/490, 769, 608

[56] References Cited

U.S. PATENT DOCUMENTS

| | | | |
|---|---|---|---|
| 344,298 | 6/1886 | Wick | 83/607 |
| 1,830,284 | 11/1931 | Massa | 83/608 |
| 3,018,806 | 1/1962 | Moore | 83/609 |
| 3,486,188 | 12/1969 | Senick | 83/564 |

FOREIGN PATENT DOCUMENTS

| | | | |
|---|---|---|---|
| 241945 | 12/1962 | Australia | 83/607 |
| 11634 | 4/1900 | Sweden | 83/607 |
| 157740 | 2/1957 | Sweden | 83/608 |

*Primary Examiner*—Frank T. Yost
*Assistant Examiner*—Hien H. Phan
*Attorney, Agent, or Firm*—Richard J. Hicks

[57] ABSTRACT

A kitchen guillotine is described in which a chopping board is provided with a pivotable sleeve device at one end thereof into which the tip of any available kitchen knife may be inserted so that a chopping action can be achieved by moving the knife handle up and down.

2 Claims, 3 Drawing Sheets

KITCHEN GUILLOTINE

This invention relates to a kitchen guillotine designed for slicing or cutting relatively hard fruits and vegetables such as apples, carrots and turnips.

Numerous guillotines and slicers have been developed over the years to slice all manner of products from paper to straw to foods such as sausages and fruits and vegetables, and such guillotines generally incorporate a relatively massive blade pivotally mounted at one end thereof to a relatively massive board or base plate. Such devices are relatively expensive, difficult to clean and, more particularly difficult to store in an average kitchen. Further, the permanently mounted blade precludes use of the board or base plate for general use as a kitchen chopping board.

It is, therefore, an object of the present invention to provide an improved chopping block arrangement which can be used either as a chopping block or as a guillotine by insertion of any available kitchen knife into a specially adapted pivot device mounted on the chopping block. Because no permanently mounted blade is provided, the device is much cheaper to manufacture and sell.

Thus by one aspect of this invention there is provided a kitchen slicer board comprising:

(a) a flat base plate having an upper surface and first and second ends;

(b) means mounted upstanding on the base plate adjacent said first end; and (c) means on said upstanding means arranged to slidably receive a selected knife blade tip therein for pivotal movement of the knife blade about an axis parallel said upper surface.

The invention will be described in more detail hereinafter with reference to the drawings in which.

Figure 1:
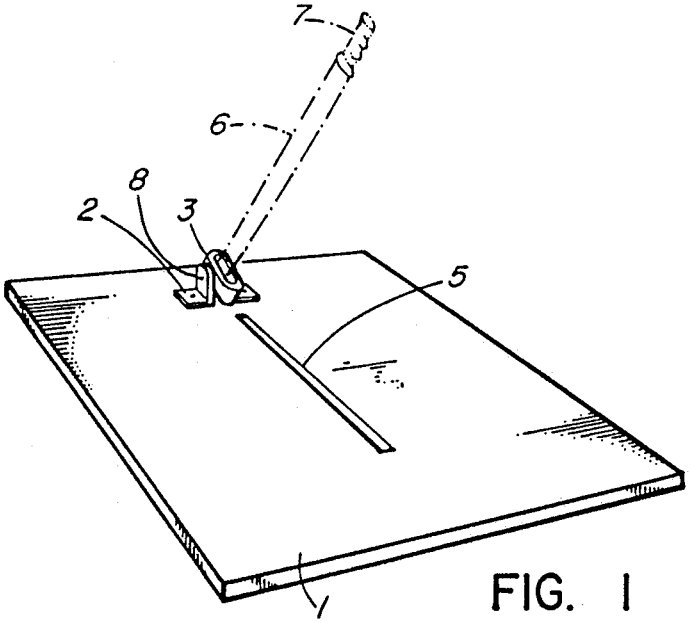
FIG. 1 is an isometric view of one embodiment of the present invention.
Figure 2:
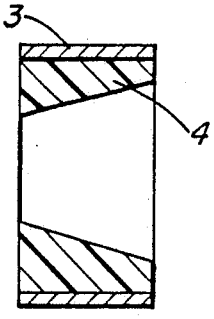
FIG. 2 is a cross-section of the pivotally mounted member shown in FIG. 1.

In FIG. 1 there is shown a chopping block 1, of any conventional and suitable size and shape, generally but not necessarily fabricated in wood. Mounted on the upper surface of block or base plate 1, and adjacent one end thereof are a pair of mutually opposed L-shaped brackets 2. A substantially rigid tubular or sleeve member 3, generally fabricated in metal, is pivotally mounted in trunnions 8 about an axis parallel to the upper surface of the base plate and between the brackets 2. Sleeve member 3 may, as shown in FIG. 2, be provided with a tapered insert generally made from a relatively rigid thermoplastics material such as nylon. A longitudinally elongated slot 5 may be provided in block 1.

In operation, the user may select a kitchen knife 6 of suitable size such as is available in any kitchen and which is shown in phantom in FIG. 1, and insert the tip thereof into sleeve member 3. The tapered hard plastic insert 4 provides a snug fit and also prevents damage to the knife tip. The fruit or hard vegetable to be cut or sliced is placed on the board over the knife edge receiving slot 5, which is provided to prevent cutting damage to the upper surface of the board, and with an up and down movement of knife handle 7, the fruit or vegetable is cut as desired.

Figure 3:
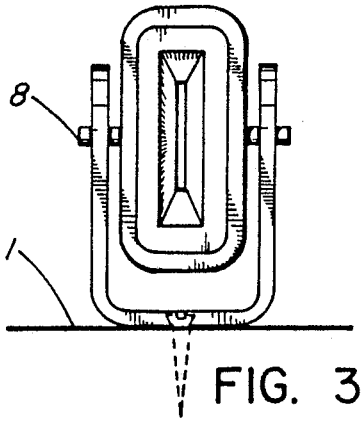
FIG. 3 is an end view of an alternative embodiment of the invention.
Figure 4:
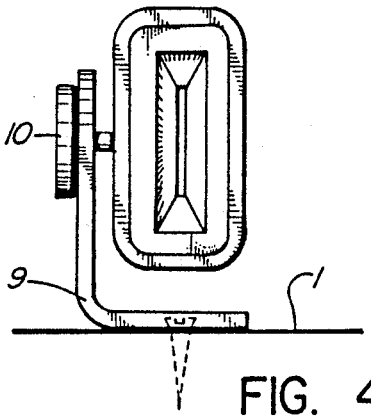
FIG. 4 is an end view of yet another alternative embodiment of the invention.

It will of course be appreciated that modifications can be made without departing from the scope of this invention. For example the L-shaped brackets may be replaced by a single U-shaped bracket as shown in FIG. 3 or indeed merely a single L-shaped bracket 9 may be used replaced by a single U-shaped bracket as shown in FIG. 3 or indeed merely a single L-shaped bracket 9 may be used as a support for the horizontal axis pin 10, as shown in FIG. 4.

Figure 5:
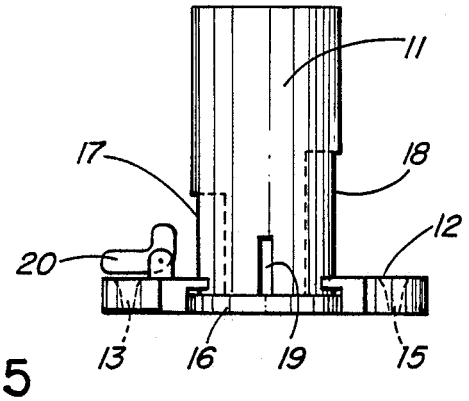
FIG. 5 is a side view of a preferred embodiment.
Figure 6:
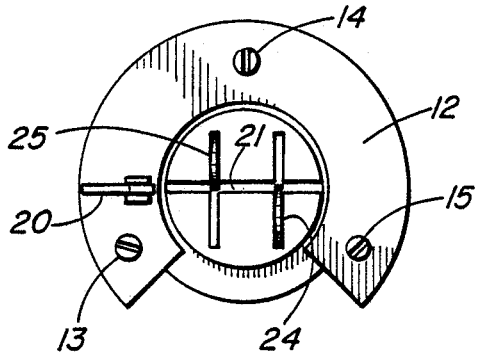
FIG. 6 is a top view of the embodiment of FIG. 5.
Figure 7:
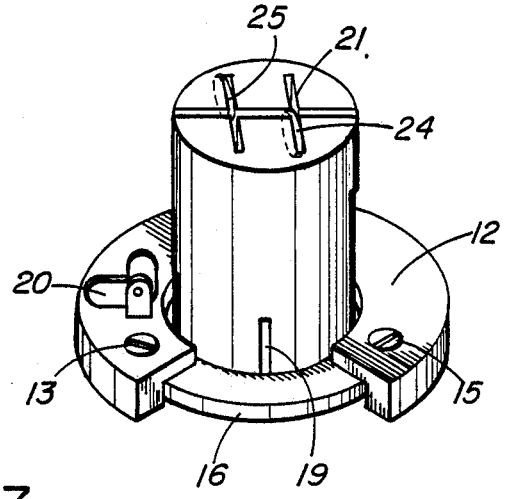
FIG. 7 is an isometric view of the embodiment of FIG. 5.

In FIGS. 5–7 there is shown an alternative embodiment of the invention in which a flanged cylindrical member 11, preferably but not essentially fabricated from a thermoplastic material such as nylon, is mounted for rotation about its axis by means of a clamping member 12, L-shaped in cross section and securable to a board 1 (as in FIG. 1) by screws 13, 14, 15, in abutment with the flange 16. The cylindrical member 11 is provided with a plurality of longitudinally extending radial slots of differing lengths 17, 18, 19. The slots 17, 18, 19 are each adapted to receive a knife blade tip of a different width. The clamping member 13 is provided with a pivotally mounted locking member 20 which may be pivoted to engage with a selected slot 17, 18 or 19 so as to lockably secure another selected slot in the knife receiving and chopping position. A knife tip may be inserted in the selected slot and pivoted about an axis perpendicular to the axis of the cylindrical member 11. If it is desired to chop in a fan shaped, or oscillating fashion, such as when chopping mint or parsley lock 20 may be disengaged from its slot, thereby allowing cylindrical member 11 to rotate about its axis while retained by L-shaped clamp 12. Optionally, a knife sharpener slot 21 may be provided at the free end of member 11. A pair of spaced slots 22, 23 are provided at right angles to slot 21 and contain pivotally mounted, hardened, steel knife sharpening wheels of conventional design. If it is desired to sharpen a knife, the edge thereof is simply inserted in slot 21 and drawn across the pair of wheels 24, 25.

Figure 8:
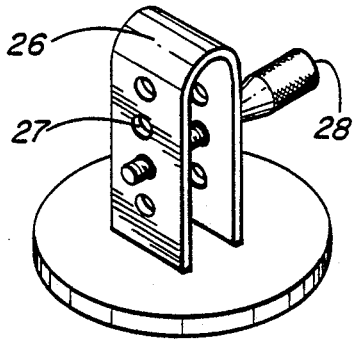
FIG. 8 is an isometric view of another preferred embodiment.

In another embodiment as shown in FIG. 8, a U-shaped member 26 is secured in upstanding fashion on board 1. Each leg of the U-shaped member is provided with a series of spaced holes 27 adapted to receive a threaded and kruled bolt 28 therethrough so as to provide a slot of selected width. A knife tip may be inserted either above or below bolt 28 in a selected position so as to permit pivotal movement of the knife blade about an axis parallel bolt 28.

Figure 9:
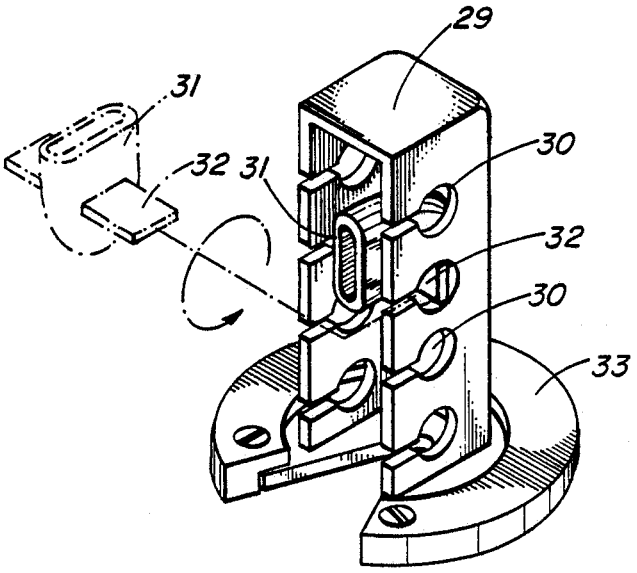
FIG. 9 is an isometric view of yet another embodiment.

In the variation of the embodiment of FIGS. 1–4 shown in FIG. 9, opposed vertical sides of a pillar 29 are provided with a plurality of complementary keyhole shaped slots 30. A sleeve member 31 having opposed flat trunions 32 extending from the sides thereof may be inserted through the open end of a selected pair of slots 30 for retention and pivotal movement about a horizontal axis in the circular portion of slots 30. As with the embodiment of FIGS. 5, 6 and 7 pillar 29 may be rotated about a vertical axis in clamping member 33 which may be employed to secure pillar 29 to a board 1.

The embodiments of the invention in which an exclusive property or privilege is claimed are defined as follows:

1. A kitchen slicer board comprising:

(a) a flat base plate having an upper surface and first and second ends;

(b) cylindrical means mounted perpendicularly by means of a flange at the lower end thereof in guide means on the base plate adjacent said first end for rotation about its longitudinal axis and (c) means on said upstanding cylindrical means arranged to slidably receive a tip of a selected knife blade therein for pivotal movement of the knife blade about an axis parallel and upper surface, and (d) lock means comprising a pivotable member mounted on said guide means and arranged to engage said cylindrical means so as to releasably lock said cylindrical means in said guide means at selected ones of a plurality of rotational positions.

2. A kitchen slicer board comprising:

(a) a flat base plate having an upper surface and first and second ends;

(b) cylindrical means mounted perpendicularly on the base plate adjacent said first end for rotation about its longitudinal axis; and (c) means on said upstanding cylindrical means arranged to slidably receive a tip of a selected knife blade therein for pivotal movement of the knife blade about an axis parallel said upper surface, said means comprising a plurality of longitudinal slots of differing length spaced radially around said cylindrical means, to receive knife blade tips of respectively different sizes.

* * * * *